United States Patent [19]

Kessler

[11] Patent Number: 4,695,293

[45] Date of Patent: Sep. 22, 1987

[54] FUEL ADDITIVE

[76] Inventor: Saul Kessler, 7020 Rivol Rd., Canoga Park, Calif. 91307

[21] Appl. No.: 773,662

[22] Filed: Sep. 20, 1985

[51] Int. Cl.[4] ..... C10L 1/20

[52] U.S. Cl. ..... 44/68; 44/72; 44/79

[58] Field of Search ..... 44/79, 72, 67, 68; 564/442, 391, 384

[56] References Cited

U.S. PATENT DOCUMENTS

| | | | |
|---|---|---|---|
| 2,689,254 | 9/1954 | Cady et al. | 44/79 |
| 3,996,115 | 12/1976 | Kessler | 204/56 R |
| 4,031,027 | 6/1977 | Kessler | 204/56 R |
| 4,145,364 | 3/1979 | Mulvey et al. | 564/442 |

*Primary Examiner*—Jacqueline V. Howard
*Attorney, Agent, or Firm*—Marvin E. Jacobs

[57] ABSTRACT

Performance is improved and wear of a combustion engine is decreased by adding a solution of a compound in a combustible diluent such as methanol. The compound is the reaction product in diluent of a fluoralkylarylamine such as trifluoro-m-toluidine and a halide salt such as boron trifluoride. The amine group is polar and can bind with water and/or provide detergency properties. The polar group can bind to metal surfaces such as engine parts to form a highly ordered film with the low friction, non-reactive fluoralkyl groups oriented to the outside. This film protects the surface from corrosion or wear and lowers the friction between moving parts.

17 Claims, 4 Drawing Figures

FUEL ADDITIVE

TECHNICAL FIELD

The present invention relates to an additive for liquid hydrocarbon fuels and, more particularly, this invention relates to an additive for gasoline or diesel fuel that improves performance while reducing emissions from an engine.

BACKGROUND ART

The consumption of oil and gas represents about 80 percent of the consumption of fossil fuels in the United States. At the present time, about onehalf of the electric power is generated from natural gas and petroleum. Petroleum resources in this country are being depleted and the United States is dependent on politically unstable and unreliable foreign governments to supply its energy needs. Moreover, the combusion of liquid fuels results in the generation of hydrocarbon pollutants that must be treated before exhaust to the atmosphere. The generation of large amounts of carbon dioxide as a byproduct of the combustion of fossil fuels may cause the so-called greenhouse effect, raising the average temperature in the atmosphere to a level high enough to melt the polar ice caps.

Fuels other than liquid and gaseous hydrocarbons, such as nuclear or hydrogen, are being investigated as are power sources other than internal combustion engines, such as fuel cells, photovoltaic cells or electric storage batteries. However, consumers are accustomed to using liquid fuels and the supply, distribution, power generation and marketing infrastructure are already in place. The demand for liquid hydrocarbon fuels for power generation and transportation is expected to double by the year 2000.

Costs of refining gasoline have increased recently since octane boosters such as tetraethyl lead can no longer be utilized in recent automobiles because lead compounds poison the platinum catalysts used in the pollution control reaction and the emission of lead in the exhaust is believed to be a toxic waste product. Therefore, more refining is necessary to produce the higher octane gasoline. The presence of tetraethyl lead has contributed to longer engine life since the combusion residue remained in the cylinder as a lubricating film which greatly extended the life of engine parts such as valves and rings.

STATEMENT OF INVENTION

It was believed that the engine life and possibly performance would be enhanced by adding a material to the engine surfaces. It was surprisingly discovered that the additive of the invention not only improved performance but also caused a substantial reduction in both hydrocarbon and carbon monoxide emissions.

The fuel additive of the invention is the reaction product of a halide such as boron trifluoride and a polyhalo-substituted alkaryl amine. The reaction product has both a highly polar, hydrophilic side chain and a non-polar, oleophilic parent nucleus. This type of molecule can attach to metal surfaces through the polar side chain to form a lubricating film. The molecule can act an emulsifier to tie up the water present in the fuel or can form closed vesicles which encapsulate water to dehydrate the fuel. The additive, and especially the boron-trifluoride component, a known catalyst, may contribute to more complete or efficient combusion of the fuel to reduce the level of hydrocarbon and carbon monoxide gasses in the engine's exhaust.

Fuel economy improvement in a wide variety of test vehicles showed a mean improvement of over 10 percent. Hydrocarbon emissions were reduced more than 90 percent of California standards. Emissions were reduced more than 95 percent in the case of carbon monoxide. The low-friction coating on the surface of engine parts reduces wear while promoting more complete combustion which augments energy derived from the fuel. Maintenance costs are lowered while performance is improved. Engines operating on fuel containing the additive of the invention run smoother and quieter. The additive treated fuel is also found to provide cleaning of carburetor and spark plug surfaces to remove carbon deposits.

Gasoline is saved and starting is improved. Moisture is removed from the fuel. Valve and valve seats are cleaned of deposits and exhaust systems are also found to be freer of deposits. The additive of the invention is absent heavy metals, such as lead that can poison catalytic pollution control equipment. None of the test vehicles shows any adverse effect operating with fuel containing the invention additive. The film forming properties of the additive of the invention will also prevent and inhibit corrosion and abrasion of vital metal surfaces of engine components.

These and many other features and attendant advantages of the invention will become apparent as the invention becomes better understood by reference to the following detailed description when considered in conjunction with the accompanying drawings.

DETAILED DESCRIPTION OF THE DRAWINGS

Figure 1:
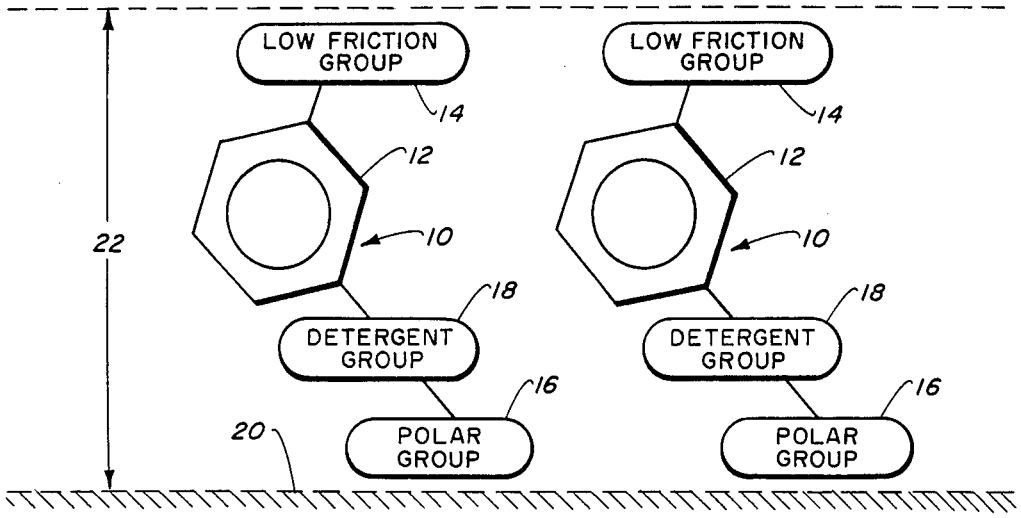
FIG. 1 is a schematic view of a functional representation of additive molecules of the invention applied to a metal surface.

The additive 10 of the invention as illustrated in FIG. 1 is formed of three components. The parent structure 12 is an oleophilic moiety, suitably an aromatic group such as benzene. The central structure is substituted with a non-polar, low friction group 14, usually a perhalocarbon group and a second polar group 16 which may also contribute detergent properties 18 to the additive. The polar groups 16 attach to a hydrophilic surface 20 such as the metal surfaces of a piston cylinder or valves or valve seats forming a monomolecular film 22 havihg a highly ordered orientation with the low friction, non-reactive, corrosion protecting groups 14 oriented to the outside. This forms a low friction sheath which provides lubrication to wearing surface and corrosion protection to all covered surfaces. When not attached to a surface, the polar groups 16 on the additive molecules 10 can associate with water and the detergent groups 18 can function in cleaning and protecting surfaces, such as carburetor or valves, removing deposits of resins or other residues which can cause engines to miss, run roughly and/or inefficiently combust expensive fuel.

A preferred additive is formed from the reaction of haloalkyl-arylamine and a halide salt to form an adduct. Boron, aluminum or titanium salts may be utilized, preferably boron trifluoride. Boron trifluoride is most conveniently handled as a complex with an ether such as diethylether.

The preferred haloalkyl-arylamines are trifluoroalkyl substituted pyridines which have a relatively high content of available and active fluorine atoms for reaction or association with the halide salt.

Preferred materials are fluoroalkyl-aryl compounds selected from those of the formula:

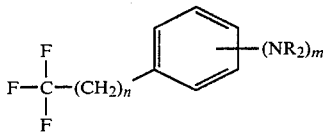

where n is an integer from 0 to 4, m is an integer from 1 to 2 and R is selected from hydrogen, lower alkyl of 1 to 9 carbon atoms, lower alkanol of 1 to 8 carbon atoms and aryl such as phenyl or aralkyl such as benzyl. A suitable material is α, α, α,-trifluoro-m-toluidine. Adducts of this nature as coatings for titanium surfaces or as additives to electroytic baths are disclosed in my prior U.S. Pat. Nos. 3,992,414, 3,996,115, 4,004,064, 4,031,027, 4,023,486, Re. 29,852 and Re. 29,739. The amino group provides polar properties and the trifluoromethyl group provides lubricating properties.

The halide and aryl amine can be reacted in bulk, in solution or suspension in a liquid. Suitable liquid diluents are polychloro substituted unsaturated aliphatic compounds such as trichloroethylene, carbon tetrachloride, tetrachloroehtylene, difluoro-dichloro-ethylene, fluorotrichloroethylene or other terminally halogenated aklenes of 1 to 8 carbon atoms or alkanols of 1 to 5 carbon atoms. For purposes of a fuel additive, it is preferred to use an alkanol since it is known that alkanols are compatible with gasoline and have similar combustion characteristics in engines.

The ratio of the ingredients can be varied within wide limits depending on the desired characteristics of the additive and the economics of maximizing yield. Since the diluent, such as methanol, is readily available at low cost, it can predominate in the reaction mixture. Satisfactory yields are obtained by including minor amounts of from 0.002 to 20 parts and preferably about 2 to 5 parts by volume of the other ingredients. Though the order of addition is not critical, it is preferable to first form a mixture of the diluent and aryl amine before adding the halide salt.

A specific example follows:

EXAMPLE 1

A coating was prepared from the following ingredients:

| Component | Range | Amount |
|---|---|---|
| Methanol | 1-200 | 600 ml |

-continued

| Component | Range | Amount |
|---|---|---|
| Boron trifluoride etherate $(C_2H_5)_2O.BF_3$ | 0.0005 to 50 | 0.2 ml |
| α,α,α,-trifluoro-m toluidine $(C_7H_6F_3N)$ | 0.002 to 100 | 0.4 ml |

In my prior patents, the toluidine and halide complex were utilized in about equal amounts. In the fuel additive of the invention, the toluidine is added in an excess amount, usually at least 50 percent more by volume than the metal salt preferably from 1.5 to 3.0 times the amount of the salt. The materials are stirred vigorously for about ten minutes. A mild exothermic rise in temperature to about 50° C. is observed when the reaction is carried out at higher concentrations to form a clear solution containing a complex which is believed to have the following structure:

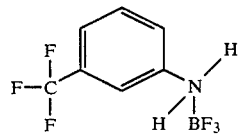

The solution was stored in 355 ml (12 oz.) high density polyethylene bottles with screw caps. The dosage amount to be added to a vehicle depends on the capacity of the fuel tank and the condition, age and displacement capacity of the engine. The 12 oz. screw cap bottle is a convenient form for adding the additive of the invention to a vehicle and has been found effective in vehicles having tanks capable of containing from 12 gallons (45.4 l) up to 24 gallons (90.8 l) of gasoline fuel. The fuel additive of the invention can be utilized with any hydrocarbon liquid fuel such as gasoline, diesel fuel, airplane fuel, jet fuel, boat or motorcycle fuels. In engines containing substantial deposits, it may be necessary to repeat the fuel treatment two or three times before optimum effect is achieved. Performance data indicates the benfits persist long after the initial use of the fuel additive. Occasional periodic treatment of adding one 12 oz. container of additive to the vehicle fuel tank once every fourth tank fill seems to maintain a minimum functional level of additive. Performance was improved with either leaded or unleaded gasoline.

Figure 3:
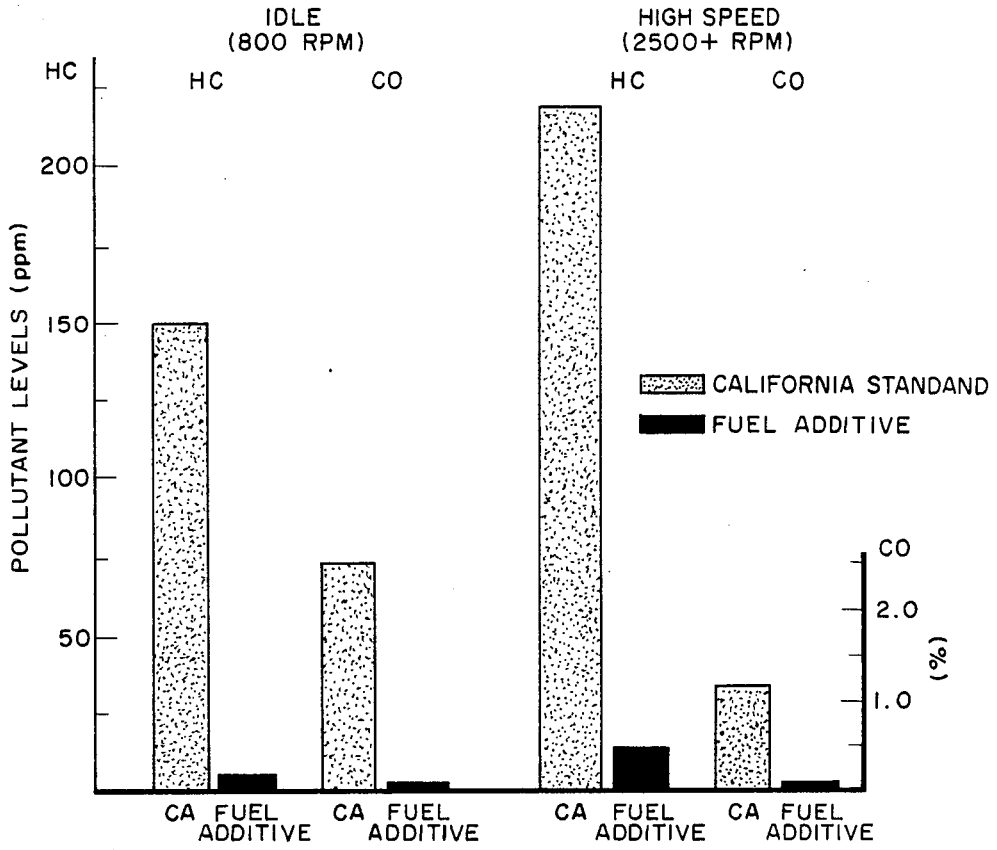
FIG. 3 is a series of bar graphs showing hydrocarbon and carbon monoxide emissions at idle and high speed from vehicles combusting gasoline containing the additive of the invention.
Figure 4:
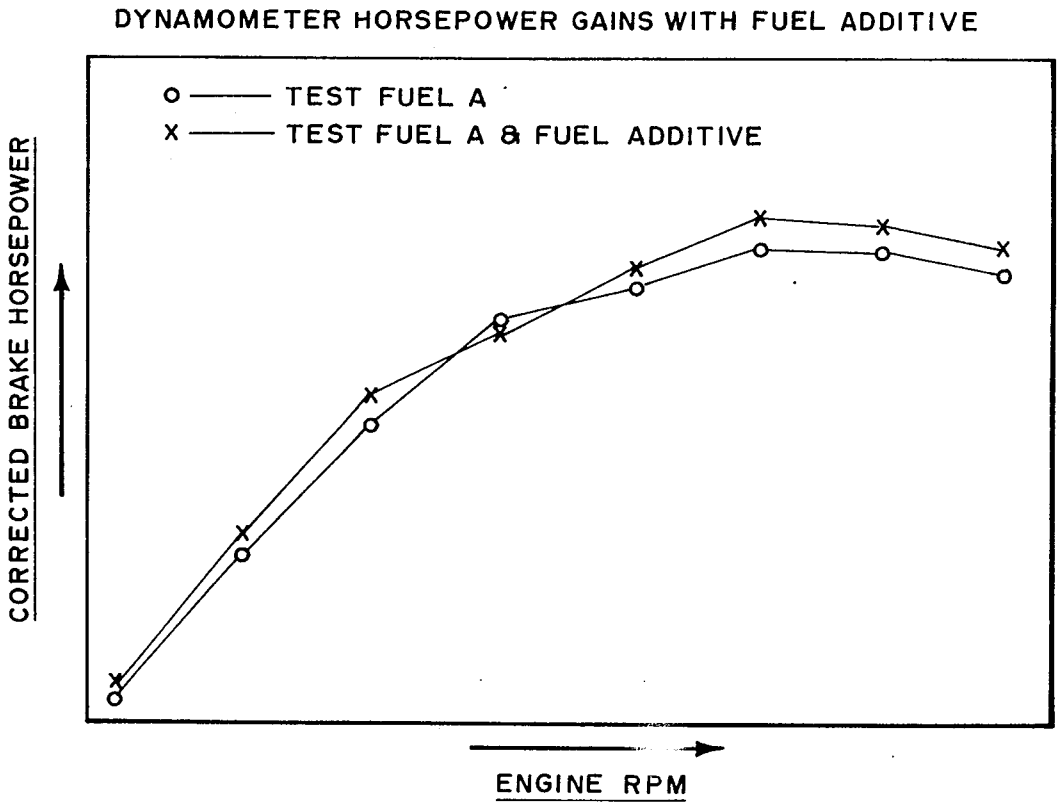
FIG. 4 is a graph comparing dynamometer horsepower generated when the additive of the invention was mixed with gasoline. The improvement was greatest at higher revolutions of the engine.

The fuel additive of Example 1 was subjected to long term testing in a two-year old 1982 Chrysler LeBaron automobile utilized primarily in city stop-and-go driving. The vehicle was equipped with a four-cylinder, transversely mounted engine and a three-speed automatic front-wheel drive transmission. As shown in FIG. 3, the observed reduction in emissions were better than 97 percent of California standards for hydrocarbons, and better than 99 percent for carbon monoxide. One 12 oz. bottle of fuel additive was added to the full twelve gallon capacity fuel tank prior to measuring exhaust emissions levels.

Fuel economy improvements in nine test vehicles participating in "real-world" testing of the fuel additive of the invention showed a mean increase of 13.2 percent. These vehicles, from a volunteer road test fleet, ranged in age from fifteen years to just several months old at the time of testing. These included a wide variety of body styles including compacts, sedans, trucks and vans, and sports cars.

In general, the larger eight cylinder engines showed better response in fuel economy increases; sometimes as much as 30 percent better. Compacts and light trucks usually showed between 2 and 15 percent increase in mileage per gallon over pre-additive fuel economy levels.

Figure 2:
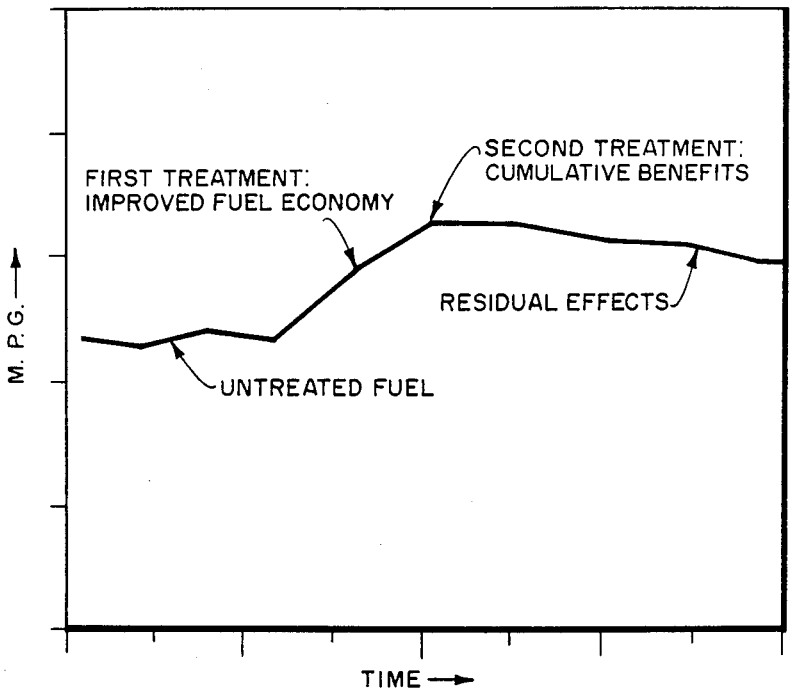
FIG. 2 is a graph showing typical gains in the fuel economy of vehicles using fuel containing the additive of the invention.

Typical gain in fuel economy is illustrated in FIG. 2. A typical gain of about 10 percent improvement in fuel economy is experienced with both first and second tankfuls of gasoline containing one 12 oz. treatment of additive before the maximum level is achieved. This level persists for several additional tankfuls while the fuel economy slowly decreases to the base, untreated level.

The additive of the invention can also be provided by addition to the fuel at the refinery. In this manner the additive is constantly being dispensed into the carburetor and engine. The additive can be added directly to the fuel or can be predispersed in methanol or other combustible diluent. Very small concentrations can be utilized since the additive is constantly injected into the engine with the fuel. As little as $10^{-3}$ grams additive per gallon of the fuel need be present, usually from $10^{-3}$ to $10^{-1}$ grams per gallon.

The additive of the invention does not poison the platinum catalytic converters. However, exhaust emissions of carbon oxides and uncombusted hydrocarbons are so low that a catalytic converter may not be needed.

Comments of drivers of the test fleet vehicles indicate smoother and quieter running and acceleration, less dark exhaust, easier engine starting even at freezing temperatures, more passing power, less knocking, better gas mileage and no more carbon build-up in the exhaust pipe.

It is to be realized that only preferred embodiments of the invention have been described and that numerous substitutions, modifications and alterations are permissible without departing from the spirit and scope of the invention as defined in the following claims.

I claim:

1. An additive for a liquid hydrocarbon fuel comprising a solution in a combustible organic diluent of about 0.0001 to 10 percent by weight of a soluble compound comprising the reaction product of a halide salt selected from the group consisting of boron halides, titanium halides or aluminum halides with a haloalkyl-arylamine of the formula:

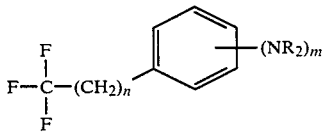

where n is an integer from 0 to 4, m is an integer from 1 to 2 and R is selected from hydrogen, lower alkyl of 1 to 9 carbon atoms, lower alkanol of 1 to 8 carbon atoms, aryl or aralkyl.

2. An additive according to claim 1 in which the halide salt is boron trifluoride.

3. An additive according to claim 1 in which the halide salt is a stabilized complex with an ether.

4. An additive according to claim 5 in which n is 0 and m is 1.

5. An additive according to claim 4 in which the haloalkyl-arylamine is α,α,α,-trifluoro-m-toluidine and the compound has the formula:

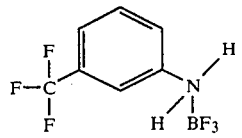

6. An additive according to claim 5 in which the diluent is a lower alkanol.

7. An additive according to claim 6 in which the diluent is methanol.

8. A fuel composition containing from 0.0005 to 15 percent of the additive of claim 1.

9. A fuel composition according to claim 8 in which the fuel is a hydrocarbon liquid selected from the group consisting of gasoline, kerosene or diesel fuels.

10. A method of treating a combustion engine comprising the step of adding the additive of claim 1 to the fuel supplied to the engine in an amount of at least $10^{-3}$ grams per gallon of fuel.

11. A method according to claim 10 in which the additive is added to the fuel tank for the engine.

12. A method according to claim 11 in which the additive is added to the fuel tank at the time of filling the tank in an incremental amount of 1 mil of additive to every liter of fuel in the fuel tank.

13. A method according to claim 12 in which the additive is added to the fuel tank for at least two successive refillings of the fuel.

14. A method according to claim 13 in which the additive level in the fuel tank is maintained by addition of additive to the tank every fourth filling of the tank.

15. A method according to claim 11 in which the additive is added to the fuel at the refinery.

16. An additive for a liquid hydrocarbon fuel comprising a solution in a combustible organic diluent of about 0.0001 to 10 percent by weight of a soluble compound comprising the reaction product of a halide of a material selected from boron, titanium or aluminum with a halo-alkyl arylamino of the formula:

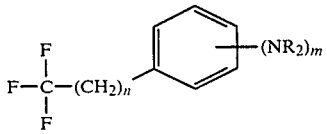

where n is an integer from 0 to 4 and m is an integer from 1 to 2 and R is selected from hydrogen, lower alkyl of 1 to 9 carbon atoms, lower alkanol of 1 to 8 carbon atoms, aryl or aralkyl.

17. A method according to claim 10 in which the additive is added to the fuel in an amount from $10^{-3}$ to $10^{-1}$ grams per gallon of fuel.

* * * * *